US006523615B2

(12) United States Patent
Gandy et al.

(10) Patent No.: US 6,523,615 B2
(45) Date of Patent: Feb. 25, 2003

(54) ELECTROPOLISHING METHOD FOR OIL FIELD TUBULAR GOODS AND DRILL PIPE

(75) Inventors: John B. Gandy, Conroe, TX (US); Roger E. Ethridge, Houston, TX (US); Charlie R. Mauldin, Conroe, TX (US)

(73) Assignee: John Gandy Corporation, Conroe, TX (US)

( * ) Notice: Subject to any disclaimer, the term of this patent is extended or adjusted under 35 U.S.C. 154(b) by 0 days.

(21) Appl. No.: 09/820,270

(22) Filed: Mar. 28, 2001

(65) Prior Publication Data

US 2001/0027867 A1 Oct. 11, 2001

Related U.S. Application Data

(60) Provisional application No. 60/194,265, filed on Mar. 31, 2000.

(51) Int. Cl.[7] ..... E21B 17/00; B23H 3/00; B23H 7/00; C25F 3/24

(52) U.S. Cl. ..... 166/381; 166/170; 166/242.4; 166/902; 138/DIG. 6; 204/224 M; 205/661

(58) Field of Search ..... 166/369, 381, 166/56, 170, 243, 242.4, 902; 138/DIG. 38; 204/272, 224 M; 205/660, 661

(56) References Cited

U.S. PATENT DOCUMENTS

| | | | | | |
|---|---|---|---|---|---|
| 3,338,807 | A | * | 8/1967 | Clifford | 205/658 |
| 3,678,567 | A | * | 7/1972 | Manilla et al. | 228/131 |
| 3,905,885 | A | * | 9/1975 | Bengel et al. | 205/646 |
| 4,245,698 | A | | 1/1981 | Berkowitz et al. | 166/244 |
| 4,483,399 | A | * | 11/1984 | Colgate | 166/308 |
| 4,637,833 | A | * | 1/1987 | Lindstrom et al. | 106/14.13 |
| 4,670,163 | A | * | 6/1987 | Lindstrom et al. | 507/256 |
| 4,705,611 | A | * | 11/1987 | Grimes et al. | 204/640 |
| 4,772,367 | A | | 9/1988 | Menzel et al. | 204/129.5 |
| 4,830,827 | A | * | 5/1989 | Au et al. | 422/7 |
| 4,849,084 | A | | 7/1989 | Vouzelland | 204/244 |
| 4,891,115 | A | | 1/1990 | Shishkin et al. | 204/212 |
| 5,507,923 | A | | 4/1996 | Stouse et al. | 205/679 |
| 5,820,653 | A | * | 10/1998 | Eamon et al. | 75/743 |
| 5,942,184 | A | * | 8/1999 | Azuma et al. | 420/67 |
| 5,958,195 | A | | 9/1999 | Lorincz et al. | 204/224 |
| 6,242,054 | B1 | * | 6/2001 | Baalmann et al. | 427/489 |

FOREIGN PATENT DOCUMENTS

DE 4039479 A1 * 6/1992 ..... B08B/03/04

OTHER PUBLICATIONS

Dowell Field Data Handbook 1997, pp. 300.014–300.030.*
Bourgoyne Jr. et al., Applied Drilling Engineering 1991, Society of Petroleum Engineers, p. 19.*

* cited by examiner

*Primary Examiner*—David Bagnell
*Assistant Examiner*—Jennifer M Hawkins Gay
(74) *Attorney, Agent, or Firm*—Bracewell & Patterson LLP

(57) ABSTRACT

A method of producing fluids from a well bore by polishing the inside diameter surface of a down-hole tubular. The method includes the steps of providing a down-hole tubular having an inside diameter and being made of a carbon steel alloy or a high chromium alloy, preparing an inside diameter surface of the down-hole tubular, subjecting the inside diameter surface to an electropolishing treatment to produce a smooth surface being slick and essentially non-stick, locating the down-hole tubular within the well bore adjacent a fluid-producing formation, and producing the fluids through the inside diameter of the down-hole tubular. The electropolishing treatment can also be applied to the inside diameter surfaces of carbon steel drill pipe.

29 Claims, 7 Drawing Sheets

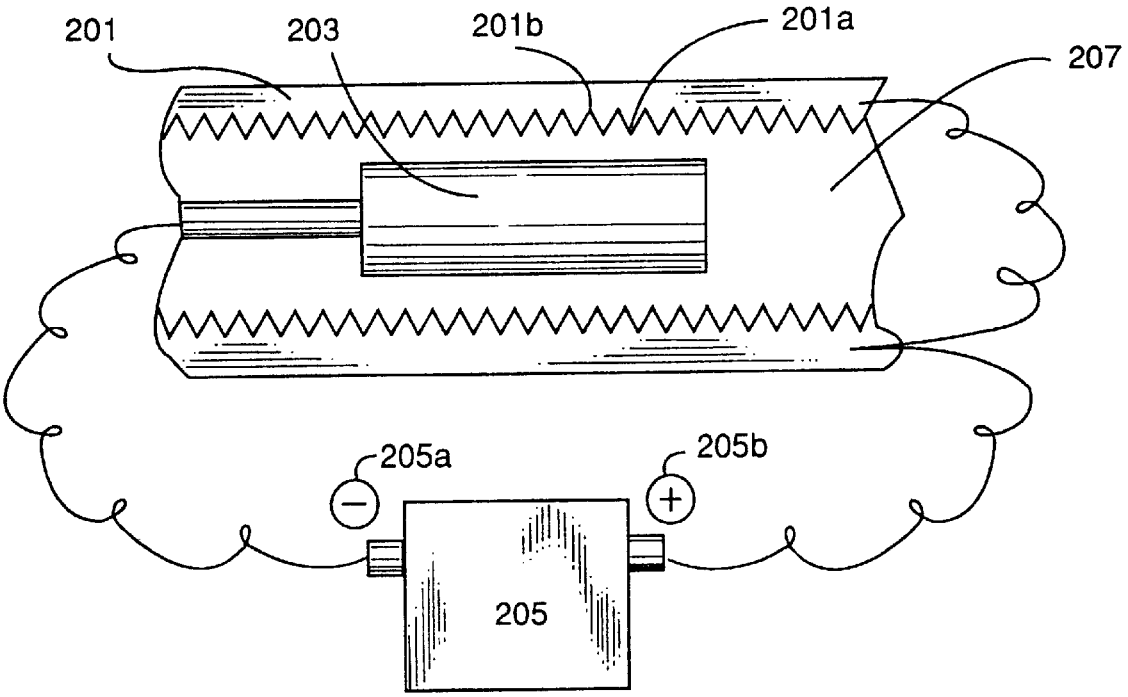
FIG. 5
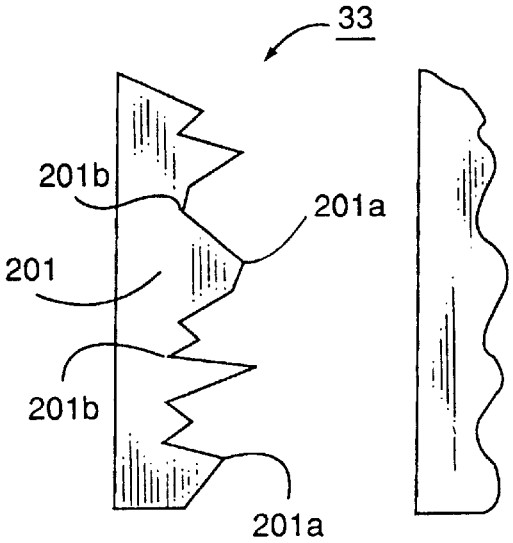
FIG. 6A
FIG. 6B

ELECTROPOLISHING METHOD FOR OIL FIELD TUBULAR GOODS AND DRILL PIPE

CROSS REFERENCE TO RELATED APPLICATIONS

The present case claims priority based upon provisional application No. 60/194,265, filed Mar. 31, 2000, by the same inventors.

BACKGROUND ART

1. Field of the Invention

The present invention relates to methods of producing fluids through a well bore from a fluid producing formation, wherein an inside diameter surface of a down-hole tubular is subjected to a smoothing process prior to being located within the well bore. The invention also relates to a smoothing process for the inside diameter surface of drill pipe used to circulate drilling fluids during well completion, both smoothing processes involving an electropolishing treatment as one step in the smoothing process.

2. Description of Related Art

The oil and gas industry is constantly seeking new ways to efficiently and economically increase production of hydrocarbon fluids. There are various ways to approach this challenge, many of which involve improvements to the oil country tubular goods, or down-hole tubulars, through which the fluids flow to the surface. There are many different factors that affect the performance of down-hole tubulars and reduce fluid flow rates including: pipe corrosion, clogging, and fluid flow friction. Corrosion occurs when a corrosive agent attacks and deteriorates the inside diameter surface of the down-hole tubular, resulting in a shortened operational life and high maintenance costs. Clogging is the accumulation of sludge and debris, such as paraffin and scale, on the inside diameter surface. Clogging results in restricted flow and reduced production. Fluid flow friction in down-hole tubulars creates significant pressure losses, resulting in reduced flow rates and decreased fluid production. If these three flow-rate reducing factors could be reduced or eliminated, fluid production could be increased, maintenance time and costs could be reduced, operational life could be extended, and smaller diameter production tubing could be used to produce the same amount of fluids that are currently being produced through larger diameter production tubing.

The present invention is concerned, in one aspect, with a smoothing process for down-hole tubulars, both those tubulars formed from corrosion resistant alloy materials (CRA) and those tubulars formed from carbon steel alloys (carbon tubing), which smoothing process involves electropolishing as an integral step.

In another aspect of the present invention, carbon steel drill pipe is subjected to a smoothing process which again involves electropolishing as an integral step in the inventive method. Drill pipe benefits from the electropolishing process in terms of both added corrosion resistance and increased flow in the same manner as do the down-hole tubular goods.

BRIEF SUMMARY OF THE INVENTION

There is a need for a method of producing fluids from a fluid producing formation through down-hole tubulars in a well bore, wherein corrosion, clogging, and fluid flow friction are reduced, thereby increasing fluid production.

It is therefore an object of the present invention to provide a method of producing fluids from a formation which includes the step of subjecting the inside diameter surfaces of the down-hole tubulars to an electropolishing treatment prior to assembly and installation into the well bore. The electropolishing treatment serves to smooth the inside diameter surface, thereby reducing corrosion, clogging, and fluid flow friction. The method includes the general steps of providing a plurality of down-hole tubulars each having an inside diameter surface; subjecting each inside diameter surface to a cleansing treatment to remove thread compound from the tubular ends and to remove contaminants from each inside diameter surface; subjecting each inside diameter surface to a pickling treatment to remove mill scale; subjecting each inside diameter surface to a mechanical polishing treatment to produce a smooth surface having an arithmetic average roughness value (Ra) of less than 100 microinches; subjecting each inside diameter surface to an electropolishing treatment to produce a smooth surface having an arithmetic roughness value of less than 50 micro inches; subjecting each inside diameter surface to a post-electropolishing treatment to remove byproducts of the electropolishing treatment and assist drying; connecting the plurality of down-hole tubulars together to form a production pipe; locating the production pipe within the well bore adjacent the fluid-producing formation; and producing the fluids to the earth's surface through the inside diameter of the down-hole tubulars.

It is another object of the present invention to provide a down-hole tubular made of a high chromium content, corrosion resistant alloy, which has been subjected to an electropolishing process to provide an inside diameter surface having an arithmetic roughness value of less than 50 micro inches, preferably less than about 30 micro inches and most preferably below about 20 micro inches.

It is also an object of the present invention is to subject traditional carbon steel tubulars and drill pipe, including upset pipe, non-upset pipe, and pipe having both threaded and plain ends to an electropolishing treatment to produce a smooth surface having an arithmetic roughness value of less than 100 micro inches, most preferably with an arithmetic roughness value between about 10 and 50 micro inches.

These and other objects and advantages of the present invention will be apparent in the following detailed description when read in conjunction with the accompanying drawings.

BRIEF DESCRIPTION OF THE DRAWINGS

The novel features believed characteristic of the invention are set forth in the appended claims. The invention itself however, as well as a preferred mode of use, will best be understood by reference to the following detailed description of an illustrative embodiment when read in conjunction with the accompanying drawings, wherein:

FIG. 5 is a simplified schematic illustrating the electropolishing process of FIG. 4;

FIGS. 6A and 6B are before-and-after exaggerated views, respectively, illustrating effects of the electropolishing process of FIG. 4 on the down-hole tubulars of FIGS. 1 and 2;

DETAILED DESCRIPTION OF THE PREFERRED EMBODIMENT

Figure 1:
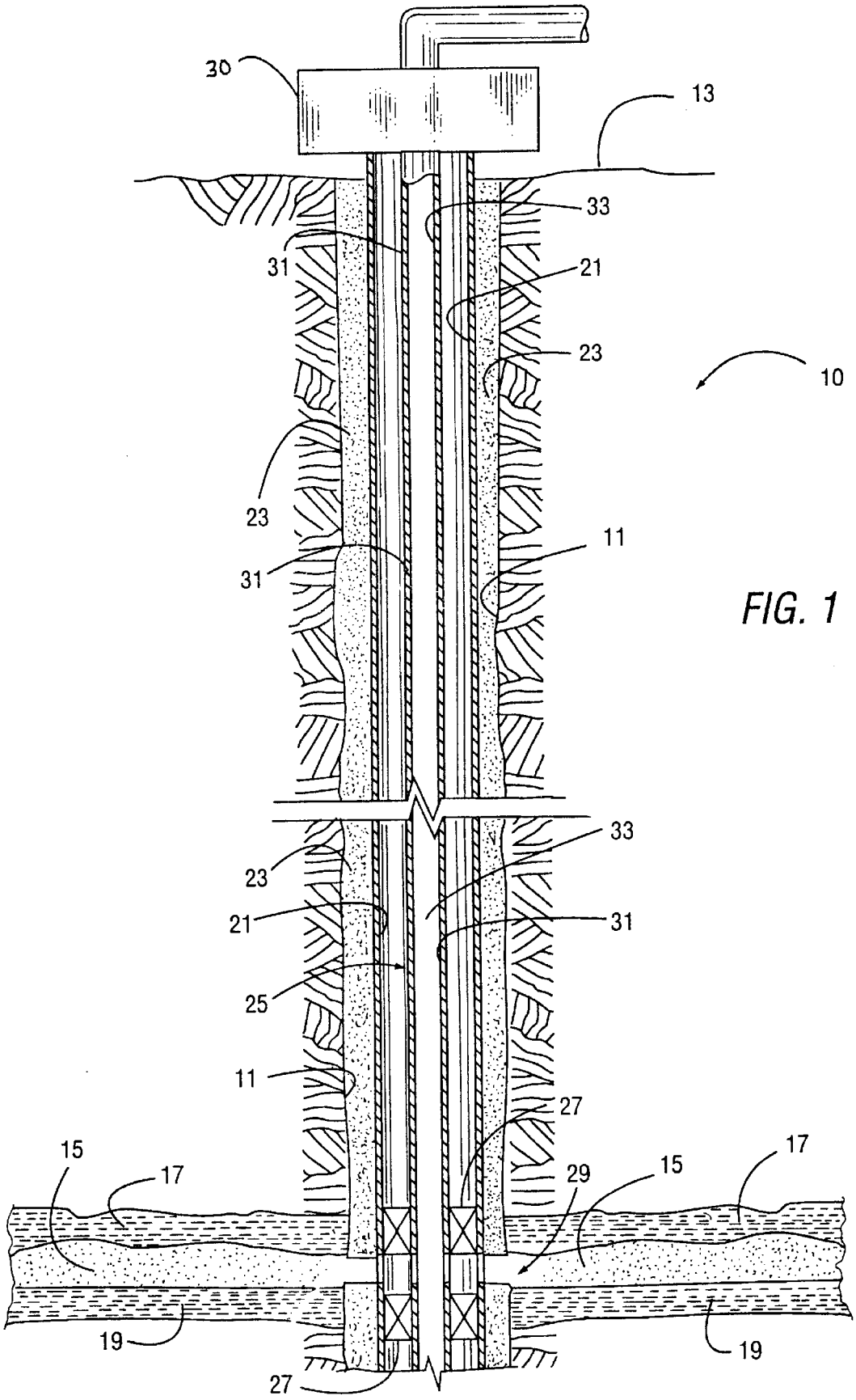
FIG. 1 is a simplified cross-sectional view of a well bore with a tubular string manufactured according to the method of the present invention.

In one aspect, the present invention addresses the problems of corrosion, clogging and fluid flow friction in oil field tubular goods, particularly with respect to both those goods formed of corrosion resistant alloys (CRA) and those goods formed of carbon steel alloys. The advantages of the invention can perhaps be best understood with reference to the existing methods employed to combat the aforementioned problems.

In regard to corrosion, one commonly used method of preventing corrosion in down-hole tubulars at the present time is to coat the inside diameter surfaces with a thin layer of an anti-corrosive material. The primary purpose of such coating is to extend the operational life of the down-hole tubular by providing a physical barrier between the corrosive agent and the base metal. Typical coating materials include paint, phenolic, epoxy, urethane, and nylon.

Another way to prevent corrosion is to make the down-hole tubulars out of a corrosion resistant alloy having a high chromium content, preferably an alloy having at least 13% chromium by weight. A good example is the carbon steel down-hole tubular having a 13% chromium content by weight sold by the John Gandy Corporation of Conroe, Tex. under the name 13 CHROME. In such alloys, chromium is the main alloying element. Although chromium is a reactive element, it and its alloys passivate and exhibit excellent resistance to various types of corrosion in many different environments.

With regard to clogging in down-hole tubulars, the best approach is to make the inside diameter surfaces as non-stick as possible. The most common method of doing this at the present time is to use some form of plastic coating to create a smooth surface. The coatings mentioned above with respect to corrosion prevention are also useful in preventing clogging. While plastic is relatively economical and easily applied, it is susceptible to wear and sloughing, resulting in decreased flow rates and fouling of production equipment.

Although corrosion and clogging have a substantial effect on fluid flow rates through down-hole tubulars, the reduction in flow rate caused by fluid friction is even more significant. The best way to address the problem of fluid flow friction is by improving or modifying the inside diameter surfaces of the down-hole tubulars through which the fluid flows. When fluid flow friction is reduced, pressure losses are reduced and flow rates are increased. In general, modifications that reduce fluid flow friction often reduce corrosion and clogging, as well. The smoother and slicker the surface, the less the surface is susceptible to deterioration or the accumulation of debris.

The industry has tried to solve these problems using a wide variety of techniques, including: chemical processing, grit blasting, $CO_2$ blasting, mechanical milling, and mechanical honing. Although these techniques have produced down-hole tubulars with improved inside diameter surfaces, they have not adequately solved the problems of corrosion, clogging, and fluid flow friction. For this reason, the present invention is concerned with reducing fluid flow friction in down-hole tubulars by creating very smooth inside diameter surfaces. Generally, the arithmetic roughness value, $R_a$, that the prior art techniques yield is greater than 100 micro inches. This arithmetic roughness value will be explained in more detail in the discussion which follows.

The friction factor for the inside diameter surface of a down-hole tubular can be estimated by determining its relative roughness measurement. There are a variety of instruments available for measuring the relative surface roughness, including: the DEKTAK$^3$ST SURFACE PROFILER and the HOMMEL T 1000, both of which are mechanical contact profiling instruments capable of providing reliable relative roughness measurements of the inside diameter surfaces of down-hole tubulars.

These instruments are capable of making very sensitive height measurements. For example, the DEKTAK$^3$ST SURFACE PROFILER employs an electromechanical measuring technique which allows it to measure surface texture in the sub-micro inch range and film thickness to 262 microns on both soft and hard surfaces. To obtain a relative roughness value for a particular sample, a standardized measurement specification is used. For example, the Deutsche Institut fuer normung c.v. Specification, DIN 4768/1 for surface roughness. According to this specification, a net scan length of 4000 microns should be used if the mean peak to valley height, $R_{ZD}$, is from 0.5 to 10 microns; and a net scan length of 12,500 microns should be used if $R_{ZD}$ is between 10 and 30 microns.

For fluids flowing in pipes, velocity, viscosity, and pipe structure are important in determining the amount of friction and the resulting pressure loss. Flow within pipes occurs in both laminar and turbulent flow regimes. In laminar flow, viscosity constrains the direction of flow of the liquid and/or gas particles in each layer to parallel paths. It is well known that the shear stress between adjacent layers in the laminar flow regime is the product of viscosity and velocity gradient. On the other hand, in turbulent flow, the viscosity does not constrain the flow direction of the particles. Rather, the liquid and/or gas particles move in a random fashion, moving past some particles and colliding with others. This random motion results in the liquid and/or gas particles being mixed.

For flow over a smooth surface, it has been shown experimentally that there is no motion of fluid particles relative to the smooth surface adjacent the smooth surface. The explanation of this phenomenon is that a very thin layer of liquid and/or gas particles, possibly only a few molecules thick, adheres to the smooth surface, and that the remaining fluid flows relative to this very thin layer. Thus, for a smooth pipe, even when turbulent flow occurs, it is always separated by a thin layer of laminar flow.

The roughness of the inside diameter surface can have a bearing on whether the flow is laminar or turbulent. It is well established that the relative roughness of the inside diameter surface of a down-hole tubular is a function of structure, viscosity, and velocity. When projections and protuberances on the inside diameter surfaces are entirely submerged in the laminar film, they have no effect on the turbulent mixing process. On the other hand, if the height of the projections or protuberances approaches or exceeds the thickness of the laminar film, turbulent flow will be produced. In fact, if the height of the projections and protuberances is relatively excessive, the existence of a laminar film may be prevented altogether.

By experimentation, it has been shown that the thickness of the laminar film is inversely proportional to the Reynolds number. Because the laminar film thickness varies with certain flow properties, it is possible for a particular inside diameter surface to be apparently smooth or rough depending upon the Reynolds number. The transition from an apparently smooth to an apparently rough surface quite often results from an increase in the Reynolds number brought about by an increase in velocity. Thus, when the velocities are relatively high, as usually is the case with fluids flowing through down-hole tubulars, the effect of surface roughness on turbulence becomes increasingly important.

The foregoing discussion makes clear that although significant strides have been made toward increasing fluid flow rates through down-hole tubulars, substantial shortcomings remain. This is particularly true concerning the particular problems of corrosion, clogging, and fluid flow friction. The present invention addresses each of these problems in terms of a method for treating the inside diameter surface of oil field tubular goods, as well as drill pipe, by subjecting these surfaces to a smoothing process which includes electropolishing as an integral step in the method.

The method of the invention can best be understood with reference to FIG. 1 in the drawings. The preferred embodiment of the method of producing fluids from a well bore by polishing the inside diameter surfaces of down-hole tubulars according to the present invention is illustrated by fluid production system 10. Fluid production system 10 consists of a well bore 11 that extends from a surface 13 of the earth to a fluid producing formation 15 beneath surface 13. Well bore 11 may be created by any of a wide variety of conventional earth boring techniques. Although well bore 11 is illustrated as a straight vertical shaft, it should be understood that well bore 11 may be curved in a variety of directions, as is common in conventional directional drilling operations.

In this case, fluid producing formation 15 is a layer of porous and fluid-permeable material, such as sandstone or limestone. Fluid producing formation 15 contains hydrocarbon fluids, such as oil and gas. It is quite common for fluid producing formation 15 to also include non-hydrocarbon products, such as water, brine, and other fluids, in both liquid and gaseous states. As is well known, formation 15 is one of many subterranean formations, and is often sandwiched between fluid-impermeable subterranean formations, such as formations 17 and 19, thereby trapping the oil, gas, and other fluids within fluid producing formation 15.

As well bore 11 is drilled, large-diameter casing pipe 21 is installed. By conventional techniques, casing cement 23 is pumped into the annulus between casing pipe 21 and the inside surface of well bore 11 to secure casing pipe 21 in place and prevent the collapse of well bore 11. Once well bore 11 has been drilled to the desired depth, production tubing 25 is installed within casing pipe 21, such that production tubing 25 extends from surface 13 to fluid producing formation 15. It is through production tubing 25 that hydrocarbons and other fluids flow from fluid producing formation 15 to surface 13. One or more conventional plug means, such as packers 27, are installed within casing pipe 21 to isolate and define a production zone 29 within fluid producing formation 15. Casing pipe 21 and production tubing 25 are perforated adjacent production zone 29 by known techniques to allow fluids from fluid producing formation 15 to flow into and up through production tubing 25 to surface 13. The fluids are received at well head 30 and distributed for processing.

Production tubing 25 is formed from a plurality of interconnected down-hole tubulars 31. Down-hole tubulars 31 include pipes, possibly of varying lengths, couplings, connectors, and a variety of other conventional tubular devices. Each down-hole tubular 31 forming production tubing 25 has an inside diameter surface 33. Although down-hole tubulars 31 may have varying lengths and outside diameters, it is preferred that down-hole tubulars 31 have as few variations in inside diameter as possible over the depth of well bore 11. A typical down-hole tubular 31 has an inside diameter of between 1.0 and 4.0 inches, and outside diameter of between 1.5 and 5.0 inches.

Inside diameter surface 33 will now be discussed in more detail. In one embodiment of the present invention, the down-hole tubulars are formed of traditional carbon steel. In another embodiment of the invention, down-hole tubulars 31 are made of a corrosion resistant alloy, preferably an alloy having a high chromium content, such as carbon steel having a chromium content of between 9% and 75% by weight. In one particularly preferred form of the invention, the alloy has a chromium content of about 40% to about 70% by weight, most preferably about 60% by weight. Because of the extreme conditions within well bore 11, particularly at great depths, it is desirable that down-hole tubulars 31 have high yield strengths, such as between 50,000 and 150,000 pounds per square inch. For this reason, it is desirable that down-hole tubulars 31 maintain this high chromium content composition throughout. In other words, low chromium content alloys that have simply been plated with the high chromium content alloy may suffice, but are not preferred. In flow line applications, yield strengths on the order of 35,000 pounds per square inch are acceptable.

For down-hole tubulars, the preferred pipe dimensions are full length tubulars having lengths in the range from about 28 feet to about 45 feet, and having outside diameters from about 2 1/16 inches to about 10 3/4 inches. Joint spacers may also be treated according to the method of the present invention and are commonly available in lengths of about 2 feet to about 10 feet. Typical classes of corrosion resistant alloy materials suitable for use in the method of the present invention include SUPER 13™, 2205, 2507, 2535, 2550, 825, and C276.

Figure 2:
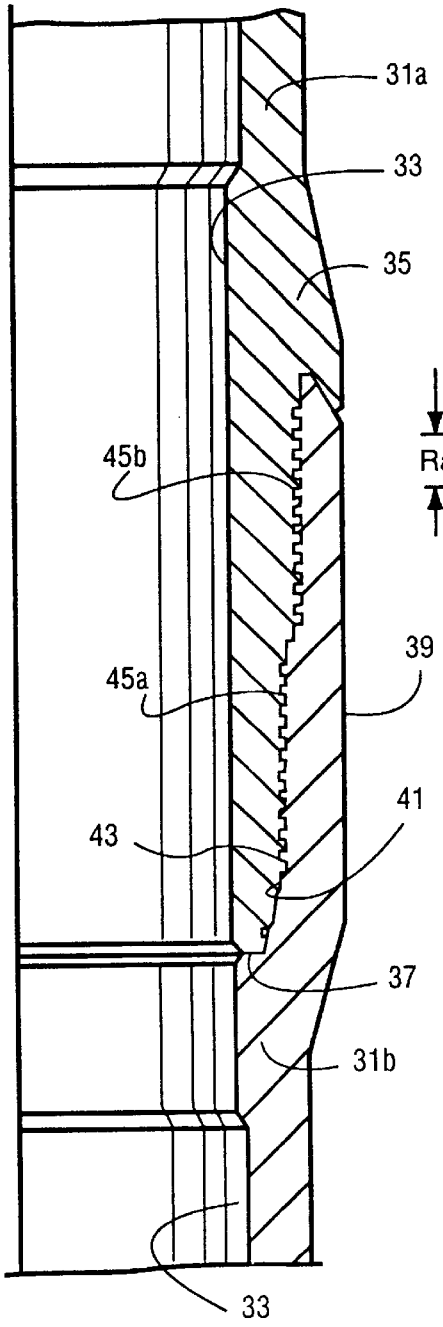
FIG. 2 is a partial cross-sectional view of a coupling joint between the down-hole tubulars of FIG. 1.

Referring now to FIG. 2, a mating joint 34 between two typical down-hole tubulars 31*a* and 31*b* is illustrated. Upper down-hole tubular 31*a* includes a pin end 35 that terminates at a nose 37. Upper down-hole tubular 31*a* is matingly received by lower down-hole tubular 31*b* that includes a box end 39 with an internal inclined surface 41 which provides a seat for a metal-to-metal seal 43 between upper down-hole tubular 31*a* and lower down-hole tubular 31*b*. As is conventional, down-hole tubulars 31*a* and 31*b* may be secured together by a first thread set 45*a* and a second thread set 45*b*. In FIG. 2, inside diameter surface 33 is enlarged and represented by a bold line. In an effort to maintain as small an outside diameter as possible, while maintaining sufficient strength at mating joint 34, some reductions in the inside diameter of down-hole tubulars 31*a* and 31*b* maybe necessary at mating joint 34. Such is the case with mating joint 34 illustrated in FIG. 2. In addition to tubulars featuring integral style mating joints, the invention can also be applied to tubulars featuring coupling style mating joints, as well as plain end tubulars having no threaded mating joint.

Figure 3:
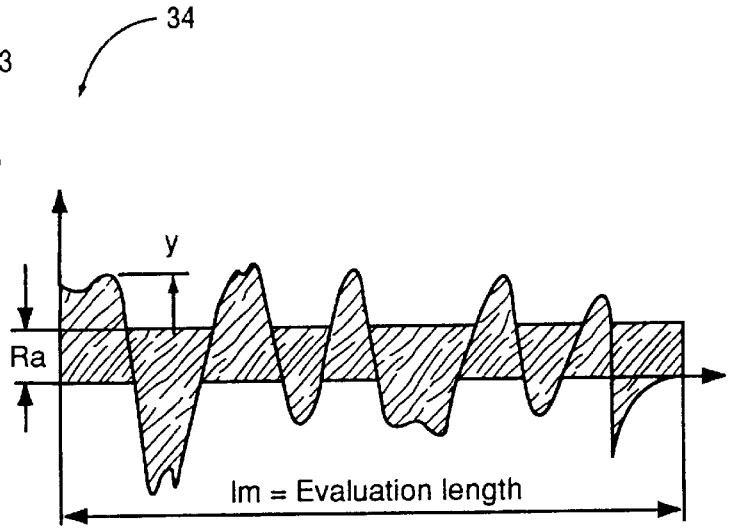
FIG. 3 PRIOR ART
FIG. 3 is a graph illustrating the arithmetic roughness profile.

Referring now to FIG. 3 in the drawings, the method of the present invention is concerned with increased production of well-bore fluids by providing and maintaining down-hole tubulars 31 having smooth inside diameter surfaces 33. For purposes of the present invention, the surface condition of inside diameter surface 33 will be expressed as a measure of relative roughness. As has been briefly discussed, there are many well known and widely accepted parameters available to express the surface roughness, or texture, of a material. Most parameters express results in either relative or absolute surface roughness values. The most widely used roughness parameter for surfaces that do not have significantly different surfaces is the arithmetic roughness, $R_a$, which is the arithmetic mean deviation of the surface profile. $R_a$ is determined by the following equation:

$$R_a = \frac{1}{l_m}\int_{x=0}^{x=l_m} |y|dx$$

where y is the profile departure in micro inches, and $l_m$ is the evaluation length in the direction x in micro inches. The above equation is represented graphically in FIG. 3. $R_a$ is determined by using a surface profiler, such as the DEKTAK$^3$ST SURFACE PROFILER described above.

Limiting variations in the inside diameter helps reduce turbulent flow of the fluids within production tubing 25. As explained above, fluids flowing through down-hole tubulars 31 may contain a wide variety of contaminants, corrosive agents, and debris. In general, these contaminants, corrosive agents, and debris may attack, invade, pit, crack, or otherwise deteriorate inside diameter surface 33. Such deterioration increases the relative roughness. For example, in a down-hole tubular 31 having a metallic inside diameter surface 33, reactions with acids can leave inside diameter surface 33 rough and pitted. In addition, if inside diameter surface 33 is relatively rough, there is an increased likelihood that sludge, paraffin, mineral scale, and other debris will attach to and accumulate upon inside diameter surface 33. As inside diameter surface 33 becomes rough, there is an increased likelihood that fluid flow will become turbulent, resulting in a decreased flow rate through production tubing 25, thereby reducing fluid production. For this reason, it is desirable that inside diameter surfaces 33 remain as smooth as possible during operation.

Figure 4:
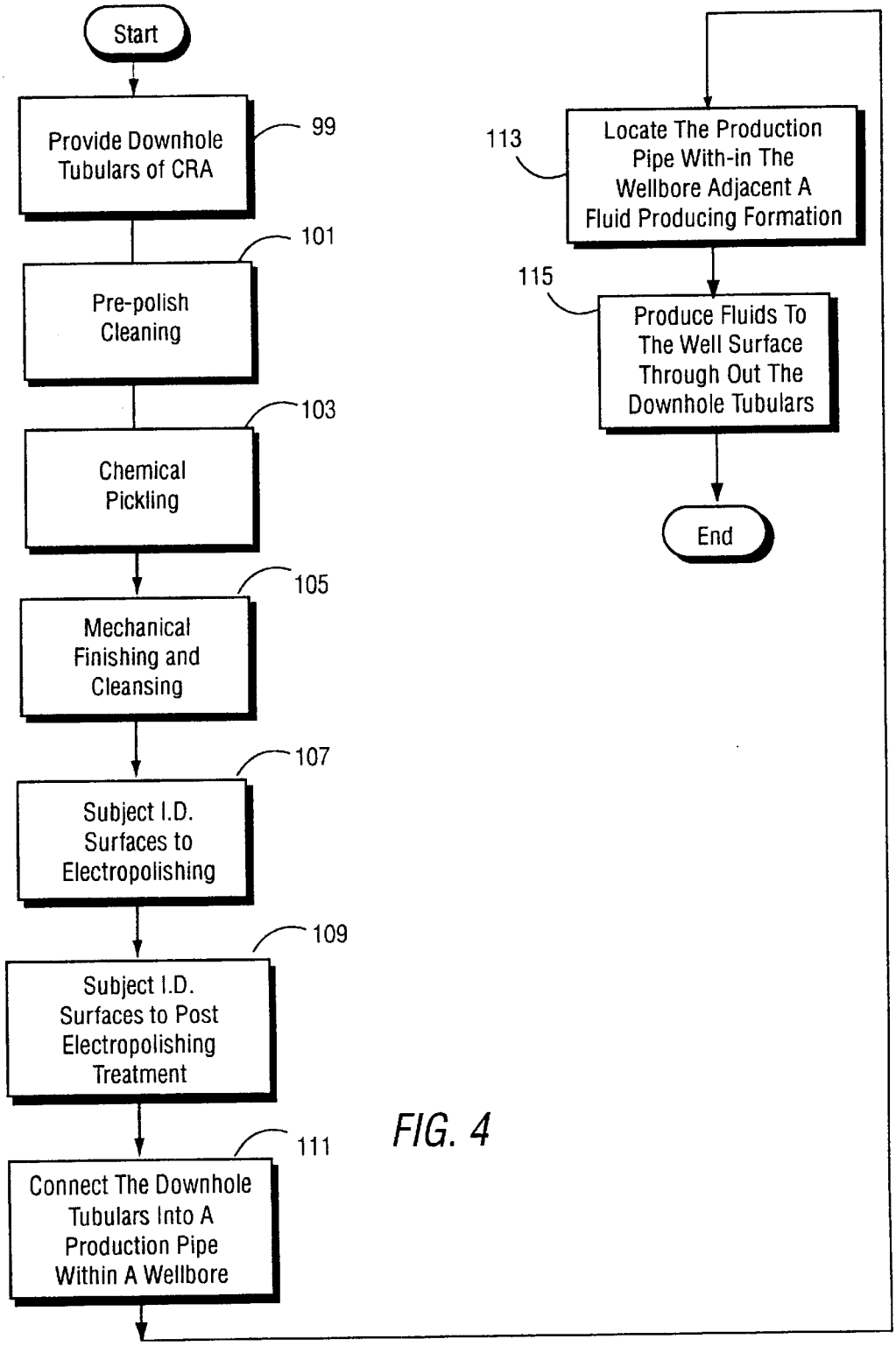
FIG. 4 is a flow chart of the steps involved in the method of the present invention.

Referring now to FIG. 4 of the drawings, the preferred embodiment of the method of the present invention is illustrated. The method begins at step 99 in which down-hole tubulars 31, in this case made of a corrosion resistant alloy, are supplied to the electropolishing plant. Next, in step 101, each down-hole tubular 31 is subjected to a cleansing treatment to remove, for example, thread compound from the threaded pipe ends as well as other contaminants. In step 103, the inside diameters of the down-hole tubulars 31 are subjected to a chemical pickling step to remove contaminants such as mill scale from inside diameter surface 33. In step 105, the tubulars are subjected to a mechanical finishing step. Then, in step 107, each inside diameter surface 33 is subjected to an electropolishing treatment to produce a smooth surface having an arithmetic roughness value of less than 50 micro inches. Next, in step 109, each inside diameter surface 33 is subjected to a post-electropolishing treatment to remove byproducts of the electropolishing treatment and to assist drying. Then, in step 111, a plurality of down-hole tubulars 31 are connected together and run within well bore 11 to form production tubing string 25. Next, in step 113, production tubing 25 is located within well bore 11 adjacent fluid producing formation 15. Then, in step 115, fluids from fluid producing formation 15 are produced at the earth's surface 13 through down-hole tubulars 31. Combined steps 101, 103, 105, 107, and 109 represent a complete electropolishing "process," as opposed to the electropolishing "treatment" represented by step 107.

Referring now to FIG. 5 in the drawings, the electropolishing treatment represented by step 107 in FIG. 4 is illustrated in a simplified schematic. Inside diameter surface 33 of down-hole tubular 31 of FIG. 1 is represented schematically by the cross-sectioned tube, workpiece 201. Initially, workpiece 201 has a relatively rough surface. In FIG. 6A, the surface profile of workpiece 201 has been greatly exaggerated to show the random arrangement of peaks 201*a* and valleys 201*b* that make up the surface of workpiece 201. A suitable conductor 203 is conductively connected to a cathodic terminal 205*a* of the DC power source 205 and workpiece 201 is conductively connected to the anodic terminal 205*b* of the DC power supply. The volume between workpiece 201 and conductor 203 is filled with a preselected electrolyte, or electropolishing solution 207 as will be described in greater detail with respect to the preferred embodiment of the apparatus illustrated in FIG. 7. Although workpiece 201 and conductor 203 are shown horizontally oriented for simplicity in FIG. 5, it will be understood that workpiece 201 and conductor 203 may assume various orientations in practice. Placement of workpiece 201 and conductor 203 in contact with the electropolishing solution 207 completes an electrical circuit.

Electropolishing takes place when a DC current is applied to the electrical circuit, resulting in the removal of metal from workpiece 201. Electropolishing is essentially the reverse of electroplating. The quantity of metal removed from workpiece 201 is proportional to the amount of current applied and the amount of time for which the current is applied. Metal is removed from the workpiece 201 first at locations of high current density, such as fine burrs. The electropolishing system depicted in FIG. 5 usually includes other conventional components and associated control systems, temperature control systems, ventilation control systems, and waste control systems.

Electropolishing Process For CRA Down-hole Tubulars

The generalized description of the electropolishing apparatus and method of FIGS. 4 and 5 will now be amplified with reference to one preferred apparatus and method of electropolishing of the invention. The description which follows describes the electropolishing of corrosion resistant tubulars having approximately 13% chromium content.

Pipe Receiving and Preparation

Shipments of 13 Chrome tubulars arrive at the plant in bolsters and are placed in covered storage. When tubulars are to be processed, a bolster is transported to the incoming end of the processing line. The tubing is removed from the bolster and placed onto a holding rack. Any thread protectors are removed from the box and pin end of each tubular and screwed together for storage if they are suitable for re-use. If not, the protectors are placed in a commercially available "Safety-Kleen" style parts cleaner (available from Safety Kleen USA) to remove any thread compound. Care is taken to ensure that the cleaning solvent utilized is contained near the end of each tube and not allowed to travel into the remainder of the tube. Following cleaning of the threaded ends, the pipe is taken to a holding area on the processing line to be staged for pickling.

Using a grinding device, the mill scale and varnish is removed along a longitudinal strip one inch wide to provide a bare metal surface on each tubular OD for anodic grounding. Preferably, the strip is positioned on the tubular OD opposite the mill stencils.

Pickling

During the manufacture of 13 Chrome tubulars, a thin layer of oxide is formed on the ID of the tube, which is commonly referred to as "mill scale." This scale is highly resistant to removal by mechanical means such as grit blasting. Because the scale acts as an insulator and reduces the effectiveness of electropolishing, the mill scale must be removed prior to the electropolishing stage. Mill scale has also been shown to create an electrogalvanic effect wherein micro galvanic cells are created throughout the inside of a tube, causing pitting and accelerating corrosion. An additional benefit of descaling by pickling is the elimination of this electrogalvanic effect associated with the mill scale.

The most efficient method of removing mill scale is to pickle the ID of the tubulars using a chemical solution. Preferably, a dilute nitric/hydrofluoric acid solution is utilized for the CRA down-hole tubulars. Because it is desirable to avoid adversely affecting the mill markings on the tubular OD's and to prevent damage to the threads, the tubulars cannot by dipped in a conventional pickling tank. Instead, a flow through system is used whereby the dilute acid mixture is pumped through the 13 Chrome tubulars via hoses connected to the threaded ends using fittings designed to preclude contact by acid. Additional benefits of this method include the enhanced performance of the pickling solution due to the agitation created by being pumped through the tubulars, plus the ability to control air emissions by using a closed system connected to a scrubber unit.

A preferred pickling solution for 13 Chrome tubulars consists of 13% nitric acid at 65% concentration plus 3% hydrofluoric acid at 49% concentration plus the balance being water. The temperature of the solution is maintained at 110° F. during processing. A storage tank having a cone bottom and a "Lakos" centrifugal separator or equivalent are used to separate precipitated metals from the solution and to deposit them onto a drum container for disposal in sludge form. This is done to reduce the disposal costs of the pickling solution, for which a surcharge is added if the solution contains solids. Transportation and disposal of the spent pickling solution and pickling sludge are contracted to a qualified outside vendor.

After the acid solution has removed the mill scale, the tubulars must be rinsed to prevent carry-over of acid into the subsequent processing. The rinse system used is a cascade design consisting of three cycles. Upon completion of pickling, the acid solution is first pumped from the tubulars leaving a minimal acid film inside the tubes. The first stage rinse uses approximately 500 gallons of lower quality water containing a buffer solution to neutralize the residual acid in the tubulars. Following adequate circulation, the first stage rinse water is pumped from the tubulars and sent to the wastewater treatment system. The second stage rinse water (approximately 500 gallons) is then circulated through the tubes until equilibrium is reached in the system. Then, the second stage rinse water is pumped from the tubulars and sent to replace that removed from the first stage reservoir. Similarly, the third stage rinse water is then circulated and pumped from the tubulars and sent to replace that removed from the second stage reservoir. That water is replaced with fresh water, making the system ready for the next cycle. The rinsed tubes are staged in a holding area on the process line, prior to mechanical polishing.

Mechanical Polishing

Figure 8:
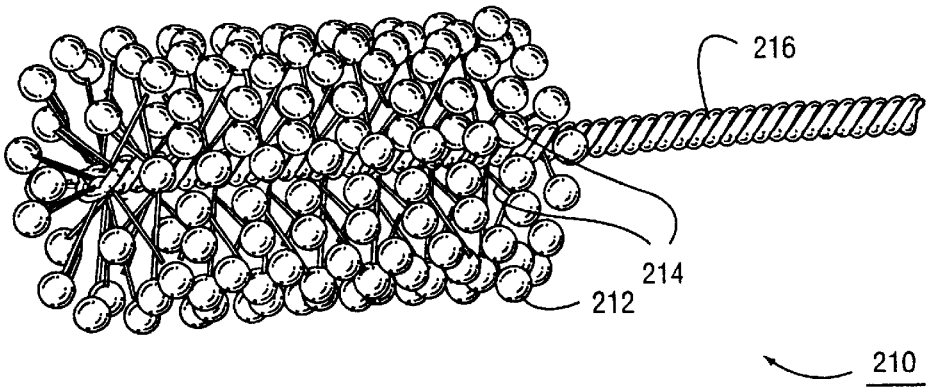
FIG. 8 is a perspective view of a brush used in mechanically finishing the inside diameter of a tubular which is to be electropolished according to the method of the invention.

The amount of time required to achieve the desired electropolishing finish is directly dependent upon the quality of surface finish at the start of electropolishing. In order to reduce the electropolishing time, it is cost effective to mechanically finish the ID's of the tubulars, thereby accomplishing a significant percentage of flattening via a less costly process. The method determined to perform the mechanical finishing most efficiently utilized "Flex Hone" brushes, one of which is shown in FIG. 8. Each "brush" 210 consists of small (⅜ inch diameter) balls 212 made of boron carbide formed on the ends of polyester brush bristles 214. The bristles are centered between two wires 216 which are then twisted to create a cylindrical brush with the boron carbide balls positioned around the circumference. The boron carbide balls are made of varying grit textures, ranging from about 20 grit to 320 grit and finer.

The mechanical polishing system utilizes a "Flex Hone" brush tool that is rotated at 1200 RPM by a commercially available hydraulic motor (not shown) while water is circulated slowly through the ID's of the tubulars. The water provides both a cooling and lubrication effect and a portion of the spalled grit is recirculated to enhance the cutting action of the brushes. Preferably, a bi-directional motor is attached to a lance that is capable of traversing the full length of either Range 2 or 3 tubulars varying in size from 2⅜ inches up to 7 inch OD. The "Flex Hone" tool is rotated one direction while going into the tubular and then the direction is reversed while the brush device is being withdrawn. This reversing action is necessary to compensate for irregularities in the circumference of the seamless tubes, especially the "plug scores" caused by the piercing mandrel being drawn through the tubulars during extrusion. In addition to reversing the direction of rotation, the tubulars are also preferably rotated to ensure uniformity of the honing action through out the tubulars.

Figure 9:
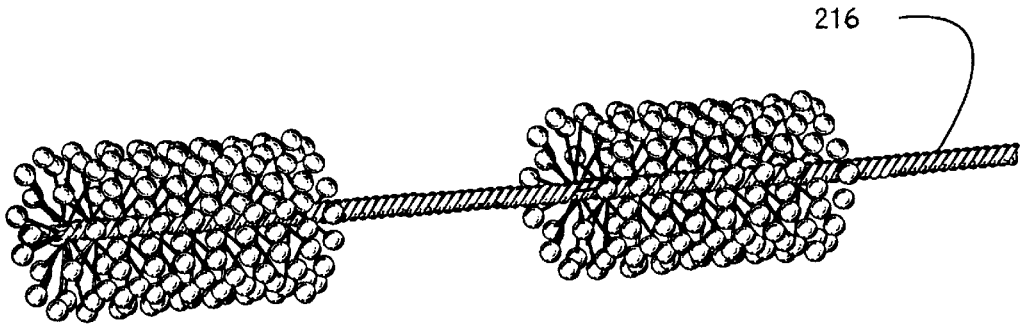
FIG. 9 is a perspective view of a pair of ganged brushes used in practicing the method of the invention.

Applicants have conducted extensive laboratory tests to evaluate the effect of grit size, rotational duration and direction, brush configuration, lubrication methods, brush wear rates and other variables in the process. Based upon the test results, an optimum combination of 60 grit brush followed by 120 grit followed by 240 grit achieves the best results for 13 Chrome. Preferably, there will be three honing lances, one at 60 grit and one at 180 grit, operating simultaneously to accomplish mechanical finishing. In order to reduce the amount of time required for each honing station to achieve the desired finish, multiple brush sets are "gang mounted" on each lance, as shown in FIG. 9. It is especially preferred that the brush stems be connected using quick release chucks or other release means. Then, as the wear on an individual brush reaches the point of inefficiency, it is removed and a new brush installed at the opposite end of the sequence going from more worn to less worn. This sequence ensures consistency in the finish achieved by each station on each tubular. As brushes are removed, they will be inspected to determine suitability for reuse. If suitable, they will be retained for future use on tubes of an appropriately smaller ID.

Following honing at the first station, the tubular is rinsed with clear water to remove any spalled grit and mill scale debris produced by the mechanical finishing step. This prevents contamination of the second system by debris that could interfere with the finer grit honing sequence. Similarly, following honing at a second station, the tubular is rinsed and air dried using forced air and then moved to a holding table prior to electropolishing.

Although the preferred method utilizes the "Flex Hone" brushes described, it will be understood that other mechanical finishing techniques can be utilized, including any one or a combination of abrasive devices such as abrasive flap wheels, cross pads, non-woven buffing wheels, etc.

The tubulars are then assembled into a rack to facilitate handling during the remainder of the electropolishing process. A preferred rack would be modifiable to hold from 12 tubulars at 2 1/16 OD down to three tubulars at 7 inch OD and be fitted with copper grounding strips to mate with a bare metal strip machined on the OD of each tubular.

Electropolishing

Electropolishing is accomplished by placing a uniquely designed cathode fixture (301 in FIG. 7) in one end of each tubular. Each tubular 307 is mounted within a bulkhead 308. The cathode will be centered inside each tubular on supports 303, 305 to provide a precise alignment between the cathode surface snd the anodic interior surface of the tubular. Each cathode will be attached to a moveable conductor rod 309 to allow precise control of the traverse speed along the length of the tubular. The tubulars are then filled with an alloy specific formulation of electrolyte which is pumped through the tubulars during the electropolishing process. The flowing electrolyte has two functions: 1) to convey the current from the anodic interior surface of the tubular to the cathode; 2) to transport any hydrogen gas bubbles that are created by the electropolishing process outside of the tubular to be collected and disposed of. The cathode conductor rods are connected to the negative terminal 311 on a direct current power supply, or rectifier 313, and the ground strips along the OD of the tubulars are connected to the positive terminal 315. After the circuit is energized, the cathodes are moved along the entire length of the tubular ID's at a precise travel speed. The current density per unit time (amps/in$^2$/min) applied to the interior surface of each tubular is carefully measured and recorded. The resultant surface roughness of the interior surface of each tubular will be less than 50 micro inches, or less than 10 micro inches, dependent upon the requirement of the intended application of the tubular.

Figure 7:
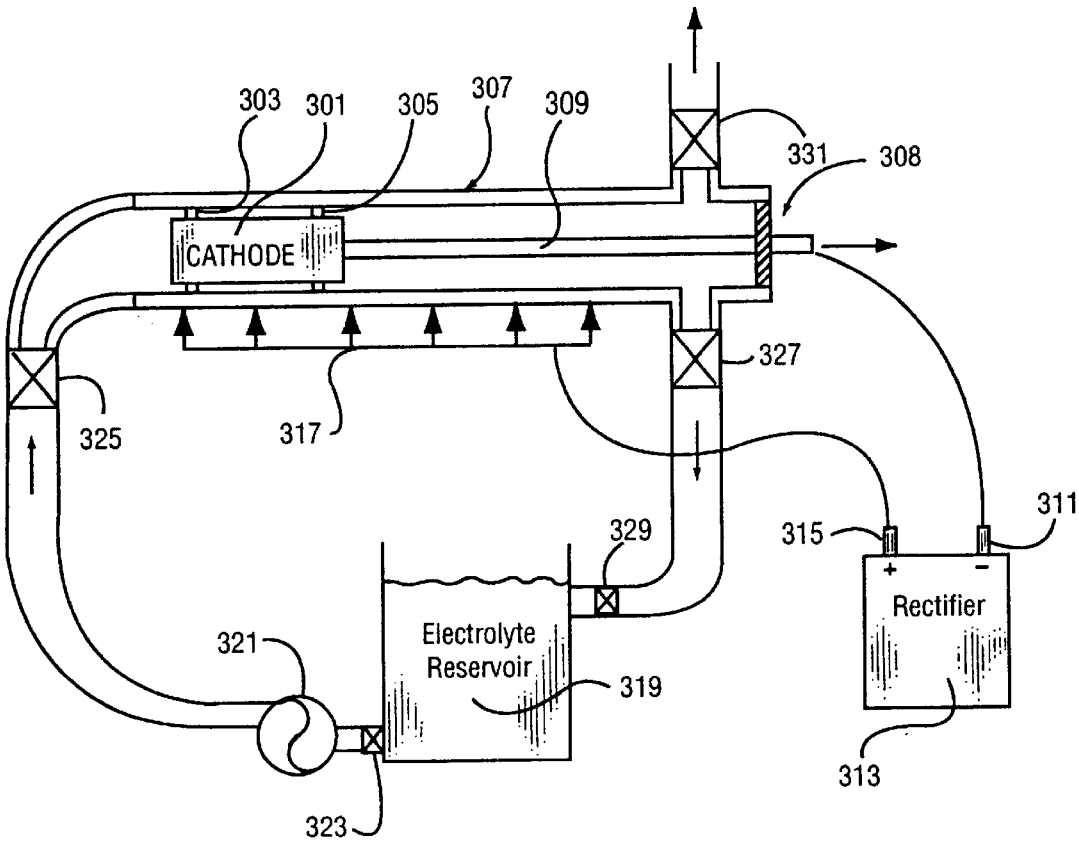
FIG. 7 is a simplified schematic of an electropolishing process which can be utilized in the method of the invention.

In the embodiment of the apparatus of FIG. 7, a continuous grounding is provided along the OD of the tubular 307 at the regions 317. Fluid flow of the electrolyte is controlled to and from the reservoir 319 and pump 321 by means of valves 323, 325, 327 and 329. A hydrogen vent 331 allows for the release of hydrogen gas bubbles.

Post Electropolishing Treatment

Following completion of the electropolishing sequence, the electrolyte will be drained from the tubulars and the tubulars purged for maximum removal of the electrolytic solution.

The full rack of electropolished tubulars will then be moved to the rinse area where the tubes will be removed from the rack assembly and connected to a closed loop rinse system. The tubes will first be power flushed using a pH controlled solution to neutralize any electrolyte remaining inside the tubulars. For example, the down-hole tubulars can be rinsed using a solution of dilute nitric acid to remove chemical residues and byproducts of the electropolishing treatment. These residues consists primarily of phosphates and sulfates of heavy metals. If not removed, these residues can reduce the quality of inside diameter surface 33. Following neutralization, rinse water will be used to power flush the tubular IDs. A sequence of three rinse cycles will be used with successively cleaner water. Following the final deionized water rinse, the tubulars will be purged to remove all moisture.

The tubulars will then be moved to the inspection area and inspected using a borescope and/or profilometer to determine the average Ra of the ID surface. Tubulars not meeting the established criteria for passing inspection will be pulled from the line and evaluated to determine what remedial action is necessary.

The electropolished tubulars are then moved to a finishing area where thread protectors are installed and the tubulars placed in bolsters and moved to covered storage awaiting loadout.

Referring now to FIGS. 6A and 6B in the drawings, the result of the electropolishing treatment on inside diameter surface 33 is illustrated in a before-and-after schematic. FIG. 6A represents workpiece 201, and consequently, inside diameter surface 33, before the electropolishing process. FIG. 6B represents inside diameter surface 33 after the electropolishing treatment. Before electropolishing, the surface profile of workpiece 201 is sharp and jagged, with pronounced peaks 201*a* and valleys 201*b*. After electropolishing, peaks 201*a* and valleys 201*b* have been dissolved, resulting in a considerably smoother surface profile. When inside diameter surface 33 of down-hole tubular 31 is smooth, for example, having an arithmetic roughness, $R_a$, of less than 100 micro inches, like the surface profile in FIG. 6B, fluids from fluid producing formation can be produced more efficiently. In particular, when inside diameter surface approaches the preferred target arithmetic roughness, $R_a$, of less than 30 micro inches, or less than 10 micro inches, dependent upon the requirement of the intended application, corrosion is reduced, clogging and/or scaling is reduced, and most importantly, the friction factor associated with turbulent flow is reduced. For example, by using the method of the present invention, the flow rate through 2.875 inch production tubing can be increased by about 22%.

Electropolishing Process For Carbon Steel Alloy Down-hole Tubulars

The process for smoothing the inside diameter surfaces of carbon steel alloy down-hole tubulars is essentially the same as that described above for CRA tubulars except that the pickling step will use a dilute hydrochloric acid solution as opposed to the combination nitric acid and hydrochloric acid solution described for CRA'S. There is also little difference in the way carbon steel production tubing is used and the way in which CRA production tubing is used in the field. The latter is more corrosion resistant in certain well environments. Both types of materials appear to benefit from the electropolishing process described in both added corrosion resistance and increased flow rates.

Electropolishing Process For Carbon Steel Drill Pipe

Oil field drill pipe can similarly benefit from the electropolishing process of the invention. Again, only the pickling step differs from the CRA process described above with a dilute hydrochloric acid solution being utilized. However, many differences exist in the way that treated drill pipe is used in the field. Whereas production tubing is used to flow fluids upwardly to the well surface or to inject fluid into a formation, drill pipe is used to drill the hole that initially completes the well. Whereas tubing stays in place for a relatively long period of time, drill pipe is run in and out of the well bore repeatedly. The primary corrosion problem with production tubing is corrosive attack from the produced well fluids. The two main corrosion problems with drill pipe are corrosion erosion and rack corrosion. The former is a result of attack from the erosive effect of the drilling mud, often containing solids, being pumped at high velocity through the ID of the drill pipe plus the effect of corrosive attack from corrosive or non-buffered contaminants in the drilling fluid. Rack corrosion is corrosion that occurs to drill pipe when it is not in the well but is stored at the surface in a rack. This corrosion is caused by contaminated drilling mud or corrosive well media being left in the drill pipe.

CRA tubulars attain their increased corrosion resistance from electropolishing primarily through the surface enrichment of the alloy and secondarily from the surface becoming smooth and featureless. Carbon tubing and drill pipe, however, derive no significant benefit from alloy enrichment on the surface but rather gain almost all their added corrosion resistance from the surface becoming smooth and featureless.

Whereas electropolished CRA is expected to need little, if any, added protection from rack corrosion, carbon tubing and drill pipe will require a corrosion inhibitor solution as a final step of the electropolishing process as well as an ongoing cleaning and maintenance program for the electropolished pipe.

Figure 10:
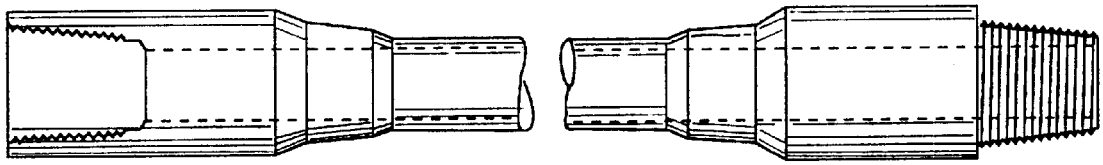
FIG. 10 is a perspective view of a section of drill pipe treated according to the method of the invention and showing the upset areas thereof.

Another significant advantage of the method of the invention, as applied to drill pipe, concerns the means for joining successive sections of drill pipe. Production tubing can be joined by an integral connection or by threaded and coupled connections. Drill pipe, however, as shown in FIG. 10 of the drawings, is generally provided with welded tool joints (401 in FIG. 10). These tool joints 401 are welded to upset pipe 403, causing a significant flow restriction at each connection (see the area 405 in FIG. 10). Accordingly, electropolishing the restricted ID area, particularly at the transition area between the tube ID and the tool joint ID, can be of significant benefit toward reducing the flow restriction and decreasing erosion or corrosion in the transition area.

Advantages of the Invention

It should be understood that other conventional smoothing techniques mentioned above, such as chemical processing, milling, honing, and $CO_2$ blasting may be employed in conjunction with the method of the present invention. The method of the present invention can be used to treat either threaded or unthreaded pipe, because the electropolishing process of the invention does not come in contact with the thread structure. The electropolishing treatment should result in inside diameter surface 33 having an arithmetic roughness value, $R_a$, of less than 100 micro inches. It is further preferred that $R_a$ be less than 50 micro inches, with a target of about 30 micro inches or less.

The present invention also provides other significant advantages. By selecting either traditional carbon steel drill pipe or tubulars or by selecting down-hole tubulars made of a high chromium content, corrosion resistant alloy, and subjecting the down-hole tubulars to the electropolishing treatment, the inside diameter surfaces are provided with a level of smoothness that has never before been obtained in like grades of down-hole materials. By incorporating an electropolishing step, the method of the invention produces a high degree of smoothness in down-hole tubulars resulting in the following: (1) reduced corrosion; (2) reduced clogging and/or scaling; and (3) reduced flow friction. Reduction in these three factors translates into increased operational life of the down-hole tubulars, reduced maintenance costs, and increased flow rates. One particular advantage achieved by using the method of the present invention is that smaller diameter electropolished production tubing can be used to produce as much fluid as larger diameter non-polished production tubing using conventional methods. The method also provides corresponding advantages in carbon steel drill pipe, especially with regard to the upset areas which traditionally present flow restrictions within the internal surface regions of the pipe.

It should be apparent from the foregoing that an invention having significant advantages has been provided. While the invention is shown in a limited number of forms, it is not limited to just these forms, but is susceptible to various changes and modifications without departing from the spirit thereof.

We claim:

1. A down-hole tubular with reduced corrosion, clogging, and fluid flow friction while producing fluids from a fluid producing formation, the down-hole tubular comprising:

a tubular body having a sidewall made of a corrosion resistant alloy, the sidewall having a chromium content of at least 9% by weight throughout;

wherein the sidewall up the tubular body defines an inside diameter surface interior to the sidewall, the inside diameter surface having been subjected to an electropolishing process, the resulting electropolished inside diameter surface having an arithmetic roughness value of less than 100 micro inches; and wherein in addition to an electropolishing process, said tubulars are produced by a process including the steps of:

subjecting each inside diameter surface to a chemical pickling treatment to remove contaminants from each inside diameter surface;

subjecting each inside diameter surface to a mechanical finishing treatment before electropolishing;

subjecting each inside diameter surface to a post-electropolishing treatment to remove byproducts of the electropolishing treatment and assist drying;

connecting the plurality of down-hole tubulars together to form a production pipe; and wherein the step of subjecting each inside diameter surface to a mechanical finishing step includes honing the inside diameter surface of each tubular with a brush consisting of hardened carbide beads formed on the ends of polyester brush bristles.

2. The down-hole tubular according to claim 1, wherein the chromium content is less than 75% by weight.

3. The down-hole tubular according to claim 1, wherein the chromium content is about 60% by weight.

4. The down-hole tubular according to claim 1, wherein the arithmetic roughness value is less than 50 micro inches.

5. The down-hole tubular according to claim 1, wherein the arithmetic roughness value is about 30 micro inches or less.

6. The down-hole tubular according to claim 1, wherein the length of the tubular body is at least twenty-five feet, and the tubular body has an outside diameter up to about eleven inches.

7. The down-hole tubular according to claim 1, wherein the length of the tubular body is at least twenty-five feet, and the inside diameter is at least one inch.

8. The down-hole tubular according to claim 1, wherein the length of the tubular body is between about two feet and about 10 feet, and the inside diameter is at least one inch.

9. The down-hole tubular according to claim 1, wherein the tubular body has an outside diameter in the range from about 2 1/16 inches to about 10 3/4 inches.

10. A method of producing fluids through a well bore extending from a fluid-producing formation to the earth's surface, the method comprising the steps of:

providing a plurality of down-hole tubulars, each down-hole tubular being made of a corrosion resistant alloy, each down-hole tubular having an inside diameter and an inside diameter surface;

subjecting each inside diameter surface to a chemical pickling treatment to remove contaminants from each inside diameter surface;

subjecting each inside diameter surface to a mechanical finishing treatment;

subjecting each inside diameter surface to an electropolishing treatment to produce a smooth surface having an arithmetic roughness value of less than 100 micro inches;

subjecting each inside diameter surface to a post-electropolishing treatment to remove byproducts of the electropolishing treatment and assist drying;

connecting the plurality of down-hole tubulars together to form a production pipe;

locating the production pipe within the well bore adjacent the fluid-producing formation;

producing the fluids to the earth's surface through the inside diameter of the down-hole tubulars; and wherein the step of subjecting each inside diameter surface to a mechanical finishing step includes honing the inside diameter surface of each tubular with a brush consisting of hardened carbide beads formed on the ends of polyester brush bristles.

11. The method according to claim 10, wherein the corrosion resistant alloy has at least 9% by weight of chromium.

12. The method according to claim 10, wherein the corrosion resistant alloy has less than 75% by weight of chromium.

13. The method according to claim 10, wherein the corrosion resistant alloy has about 60% by weight of chromium.

14. The method according to claim 10, wherein the smooth surface has an arithmetic roughness value of less than 70 micro inches.

15. The method according to claim 10, wherein the smooth surface has an arithmetic roughness value of about 30 micro inches.

16. The method according to claim 10, wherein the the tubulars are pickled prior to mechanical finishing, which procedure comprises the steps of:

subjecting each inside diameter surface to a dilute nitric/hydrofluoric acid solution which is pumped into the inside diameter of the tubulars.

17. The method according to claim 10, wherein the step of subjecting each inside diameter surface to an electropolishing treatment comprises the steps of:

conductively coupling each inside diameter surface to a cathode of a direct current power source;

contacting each inside diameter surface with a preselected electrolyte solution;

conductively coupling a conductor to an anode of the direct current power source;

submerging the conductor in the electrolyte solution;

electropolishing each inside diameter surface by supplying a current from the direct current power source;

removing the electrolyte solution from each inside diameter surface after each inside diameter surface has been electropolished; and counter-flow rinsing each inside diameter surface to remove and recover the electropolishing solution.

18. A method of producing fluids through a well bore extending from a fluid-producing formation to the earth's surface, the method comprising the steps of:

providing a plurality of down-hole tubulars, each down-hole tubular being made of a corrosion resistant alloy, each down-hole tubular having an inside diameter and an inside diameter surface;

subjecting each inside diameter surface to a chemical pickling treatment to remove contaminants from each inside diameter surface;

subjecting each inside diameter surface to a mechanical finishing treatment;

subjecting each inside diameter surface to an electropolishing treatment to produce a smooth surface having an arithmetic roughness value of less than 100 micro inches;

subjecting each inside diameter surface to a post-electropolishing treatment to remove byproducts of the electropolishing treatment and assist drying;

connecting the plurality of down-hole tubulars together to form a production pipe;

locating the production pipe within the well bore adjacent the fluid-producing formation;

producing the fluids to the earth's surface through the inside diameter of the down-hole tubulars; and wherein the step of subjecting each inside diameter surface to a post-electropolishing treatment comprises the steps of:

soaking each inside diameter surface in dilute nitric acid to remove chemical residues and byproducts of the electropolishing treatment;

rinsing each inside diameter surface with water to remove remaining traces of chemical byproducts and residue.

19. A method of producing fluids through a well bore extending from a fluid-producing formation to the earth's surface, the method comprising the steps of:

providing a plurality of down-hole tubulars, each down-hole tubular being formed of a carbon steel alloy, each down-hole tubular having an inside diameter and an inside diameter surface;

subjecting each inside diameter surface to a chemical pickling treatment to remove contaminants from each inside diameter surface;

subjecting each inside diameter surface to a mechanical finishing treatment;

subjecting each inside diameter surface to an electropolishing treatment to produce a smooth surface having an arithmetic roughness value of less than 100 micro inches;

subjecting each inside diameter surface to a post-electropolishing treatment to remove byproducts of the electropolishing treatment and assist drying;

connecting the plurality of down-hole tubulars together to form a production pipe;

locating the production pipe within the well bore adjacent the fluid-producing formation;

producing the fluids to the earth's surface through the inside diameter of the down-hole tubulars; and wherein the step of subjecting each inside diameter surface to a mechanical finishing step includes honing the inside diameter surface of each tubular with a brush consisting of hardened carbide beads formed on the ends of polyester brush bristles.

20. The method according to claim 19, wherein the smooth surface has an arithmetic roughness value of less than 70 micro inches.

21. The method according to claim 19, wherein the smooth surface has an arithmetic roughness value of about 30 micro inches.

22. The method according to claim 19, wherein the step of subjecting each inside diameter surface to a cleansing treatment comprises the steps of:

subjecting each inside diameter surface to a dilute hydrochloric acid solution which is pumped into the inside diameter of the tubulars.

23. The method according to claim 19, wherein the step of subjecting each inside diameter surface to an electropolishing treatment comprises the steps of:

conductively coupling each inside diameter surface to a cathode of a direct current power source;

contacting each inside diameter surface with a preselected electrolyte solution;

conductively coupling a conductor to an anode of the direct current power source;

submerging the conductor in the electrolyte solution;

electropolishing each inside diameter surface by supplying a current from the direct current power source;

removing the electrolyte solution from each inside diameter surface after each inside diameter surface has been electropolished; and counter-flow rinsing each inside diameter surface to remove and recover the electropolishing solution.

24. The method according to claim 19, wherein the step of subjecting each inside diameter surface to a post-electropolishing treatment comprises the steps of:

rinsing each inside diameter surface with water to remove remaining traces of chemical byproducts and residue;

drying each inside diameter surface to remove all moisture; and applying a rust inhibitor treatment to each inside diameter surface.

25. A method of completing a well bore using a string of carbon steel drill pipe having a drill bit afixed thereto for disintegrating earthen formations, the method comprising the steps of:

providing a string of drill pipe made up of a plurality of pipe sections formed of carbon steel, each pipe section having an inside diameter and an inside diameter surface;

subjecting each inside diameter surface to a chemical pickling treatment to remove contaminants from each inside diameter surface;

subjecting each inside diameter surface to a mechanical finishing treatment;

subjecting each inside diameter surface to an electropolishing treatment to produce a smooth surface having an arithmetic roughness value of less than 100 micro inches;

subjecting each inside diameter surface to a post-electropolishing treatment to remove byproducts of the electropolishing treatment and assist drying;

connecting the plurality of pipe sections together to form the string of drill pipe;

afixing a drill bit to the drill pipe and running the string of drill pipe into the well bore;

circulating drilling fluid down the inside diameter of the pipe string while drilling in order to cool the drill bit and circulate drill cuttings to the well surface; and wherein the step of subjecting each inside diameter surface to a mechanical finishing step includes honing the inside diameter surface of each tubular with a brush consisting of hardened carbide beads formed on the ends of polyester brush bristles.

26. The method according to claim 25, wherein the smooth surface has an arithmetic roughness value of less than 70 micro inches.

27. The method according to claim 25, wherein the step of subjecting each inside diameter surface to a cleansing treatment comprises the steps of:

subjecting each inside diameter surface to a dilute hydrochloric acid solution which is pumped into the inside diameter of the tubulars.

28. The method according to claim 25, wherein the step of subjecting each inside diameter surface to an electropolishing treatment comprises the steps of:

conductively coupling each inside diameter surface to a cathode of a direct current power source;

contacting each inside diameter surface with a preselected electrolyte solution;

conductively coupling a conductor to an anode of the direct current power source;

submerging the conductor in the electrolyte solution;

electropolishing each inside diameter surface by supplying a current from the direct current power source;

removing the electrolyte solution from each inside diameter surface after each inside diameter surface has been electropolished; and counter-flow rinsing each inside diameter surface to remove and recover the electropolishing solution.

29. The method according to claim 25, wherein the step of subjecting each inside diameter surface to a post-electropolishing treatment comprises the steps of:

rinsing each inside diameter surface with water to remove remaining traces of chemical byproducts and residue;

drying each inside diameter surface to remove all moisture; and applying a rust inhibitor treatment to each inside diameter surface.

* * * * *